US006595144B1

(12) United States Patent
Doyle

(10) Patent No.: US 6,595,144 B1
(45) Date of Patent: Jul. 22, 2003

(54) ADJUSTABLE LEG ASSEMBLY

(75) Inventor: James E. Doyle, Grandville, MI (US)

(73) Assignee: Suspa Incorporated, Grand Rapids, MI (US)

( * ) Notice: Subject to any disclaimer, the term of this patent is extended or adjusted under 35 U.S.C. 154(b) by 0 days.

(21) Appl. No.: 09/573,065

(22) Filed: May 17, 2000

(51) Int. Cl.[7] ..... A47B 9/00
(52) U.S. Cl. ..... 108/147; 248/188.4
(58) Field of Search ..... 108/20, 147, 144.11, 108/144.19; 248/188.4

(56) References Cited

U.S. PATENT DOCUMENTS

| | | | | |
|---|---|---|---|---|
| 3,458,788 | A | | 7/1969 | Ljung |
| 3,896,744 | A | | 7/1975 | Goebl |
| 4,352,479 | A | | 10/1982 | Chapman, Jr. |
| 4,440,096 | A | | 4/1984 | Rice et al. |
| 4,456,212 | A | | 6/1984 | Raftery |
| 4,502,393 | A | | 3/1985 | Kaiser |
| 4,593,874 | A | | 6/1986 | Dunagan |
| 4,604,955 | A | | 8/1986 | Fleischer et al. |
| 4,619,208 | A | | 10/1986 | Kurrasch |
| 4,627,364 | A | * | 12/1986 | Klein et al. ..... 108/147 |
| 4,651,652 | A | | 3/1987 | Wyckoff |
| 4,655,426 | A | | 4/1987 | von Dulong et al. |
| 4,667,605 | A | | 5/1987 | Bastian |
| 4,711,184 | A | | 12/1987 | Wallin et al. |
| 4,766,422 | A | | 8/1988 | Wolters et al. |
| 4,852,500 | A | | 8/1989 | Ryberg et al. |
| 4,910,816 | A | | 3/1990 | Lansing |
| 4,927,127 | A | | 5/1990 | Lock |
| 4,981,085 | A | | 1/1991 | Watt |
| 5,088,421 | A | | 2/1992 | Beckstead |
| 5,101,736 | A | | 4/1992 | Bommarito et al. |
| 5,174,223 | A | | 12/1992 | Nagy et al. |
| 5,224,429 | A | | 7/1993 | Borgman et al. |
| 5,243,921 | A | | 9/1993 | Kruse et al. |
| 5,259,326 | A | | 11/1993 | Borgman et al. |
| 5,282,593 | A | | 2/1994 | Fast |
| 5,285,733 | A | | 2/1994 | Waibel |
| 5,289,782 | A | | 3/1994 | Rizzi et al. |
| 5,322,025 | A | | 6/1994 | Sherman et al. |
| 5,323,695 | A | | 6/1994 | Borgman et al. |
| 5,337,678 | A | * | 8/1994 | Grout ..... 108/147 |
| 5,400,721 | A | | 3/1995 | Greene |
| 5,443,017 | A | | 8/1995 | Wacker et al. |
| 5,447,099 | A | | 9/1995 | Adams et al. |
| 5,479,852 | A | | 1/1996 | Lloyd |
| 5,495,811 | A | | 3/1996 | Carson et al. |
| 5,553,550 | A | | 9/1996 | Doyle |
| 5,598,788 | A | | 2/1997 | Jonker |
| 5,601,037 | A | * | 2/1997 | Meyer et al. ..... 108/147 |
| 5,601,348 | A | | 2/1997 | Minkovski |
| 5,685,510 | A | | 11/1997 | Frankish |
| 5,890,438 | A | | 4/1999 | Frankish |
| 5,918,505 | A | | 7/1999 | Jensen |
| 5,941,182 | A | * | 8/1999 | Greene ..... 108/147 |

* cited by examiner

*Primary Examiner*—Lanna Mai
*Assistant Examiner*—Jerry A. Anderson
(74) *Attorney, Agent, or Firm*—Price, Heneveld, Cooper, DeWitt & Litton

(57) ABSTRACT

An adjustable leg assembly includes a base leg which receives a pair of spaced, multiple section slides, each having one end coupled to a motor actuator attached to the underside of a work surface and an opposite end coupled to the base leg. The slides provide lateral strength for the motion between raised, lowered, and intermediate adjustable positions and provide a trim cover for concealing the drive mechanism employed for adjusting the table height. A pair of trim strips are mounted to an actuator on the underside of the table surface to extend in the areas between the slides for concealing the actuator mechanism which extends to the base leg. In a still further preferred embodiment, the base leg is an extrusion having a plurality of mounting apertures formed therein and trim panel receiving slots such that the appearance of the adjustable leg assembly can be modified for a given work environment and décor.

21 Claims, 7 Drawing Sheets

ADJUSTABLE LEG ASSEMBLY

BACKGROUND OF THE INVENTION

The present invention relates to an adjustable leg assembly and particularly to a motor-driven leg assembly which can be employed for controlling the height of a work surface.

As the work place environment changes with technology, so too do the facilities employed by companies to provide ergonomically appropriate work stations for technical, clerical, and assembly personnel. In order to accommodate different job tasks, frequently it is desirable to have a work surface which is vertically adjustable, such that the work surface can be employed by individuals in a standing position, in a sitting position on an office chair, or in an intermediate position when using, for example, a stool-height seat. With the ubiquitous use of personal computers, multiple adjustable table heights accommodate different individual needs for placing a monitor, for example, at a level, which may be different than the writing surface or the work surface on which the computer controls are employed. There exists, therefore, an increasing need for a work surface which has an adjustable height and one which can be economically manufactured to provide desired movement and which esthetically blends with an office decor or other working environment.

There exists numerous adjustable table assemblies which are either mechanically controlled by, for example, a screw-jack mechanism or which are electrically controlled screw jacks. Some installations employ hydraulic cylinders with a pump for moving fluid from a master cylinder to slave cylinders mounted within telescopic legs of a table for controlling the vertical adjustment of the work surface. These systems typically employ telescopic tubes which conceal the actuators, be they mechanical, hydraulic or electrical, such that the work station base is coupled to a fixed outer tube and a telescopic inner tube surrounds an actuator, such as a hydraulic cylinder or screw jack coupled to a motor mounted to the undersurface of the table. Although such construction adequately provides the table motion, such designs limit the ability of the office designer to incorporate such tables in a variety of work place environments where, for example, an executive office may include such a work station, as may and assembly area, which typically require entirely different levels of decor.

It would be desirable, therefore, to provide a leg adjustment system which has universal application to a variety of work environments and one which is relatively inexpensive to manufacture, reliable in operation and provides an esthetic appearance which conforms to modern day work environments.

SUMMARY OF THE INVENTION

The adjustable leg assembly of the present invention satisfies this need by providing a mounting system in which an outer support or base leg receives a pair of spaced, multiple section slides, each having one end coupled within the base leg and the opposite end coupled to a motor actuator secured to the underside of a work surface. The slides provide lateral strength and stability for the telescopic motion between raised, lowered, and intermediate adjustable positions and provide a trim cover for concealing the drive mechanism employed for adjusting the work surface.

In the preferred embodiment of the invention, each adjustable leg assembly includes a rectilinear base leg with opposite sides on which there are mounted a pair of slides having one member of each slide fixed to the base leg and an opposite movable end of each slide coupled to a motor actuator secured to the underside of the work surface. A pair of trim strips are mounted to extend in the areas between the slides for concealing the actuator mechanism which extends between the base leg and the table surface. In a still further preferred embodiment of the invention, the base leg is an extrusion having a plurality of mounting apertures formed therein and trim panel receiving slots such that the appearance of the adjustable leg assembly can be modified for a given work environment and decor.

The adjustable leg assembly so-formed can accommodate a variety of actuators, such as hydraulic cylinders or screw jacks, although in the preferred embodiment electrically driven screw jacks are employed. The adjustable leg assembly of the present invention, therefore, provides an economical, reliable and sturdy leg assembly which can be employed with a variety of work surfaces including single pedestal or multiple leg table supports or for multiple tables used in conjunction with one another. The design of the adjustable coupling between the base leg and table top provides both a strong and reliable mechanism as well as one which accommodates the, décor of a variety of work environments. Further, in a preferred embodiment of the invention, the base legs and one or more cross members are extruded of the same design to reduce cost, accommodate assembly, and receive slide-in trim panels.

These and other features, objects and advantages of the present invention will become apparent upon reading the following description thereof together with reference to the accompanying drawings.

DETAILED DESCRIPTION OF THE PREFERRED EMBODIMENT

Figure 1:
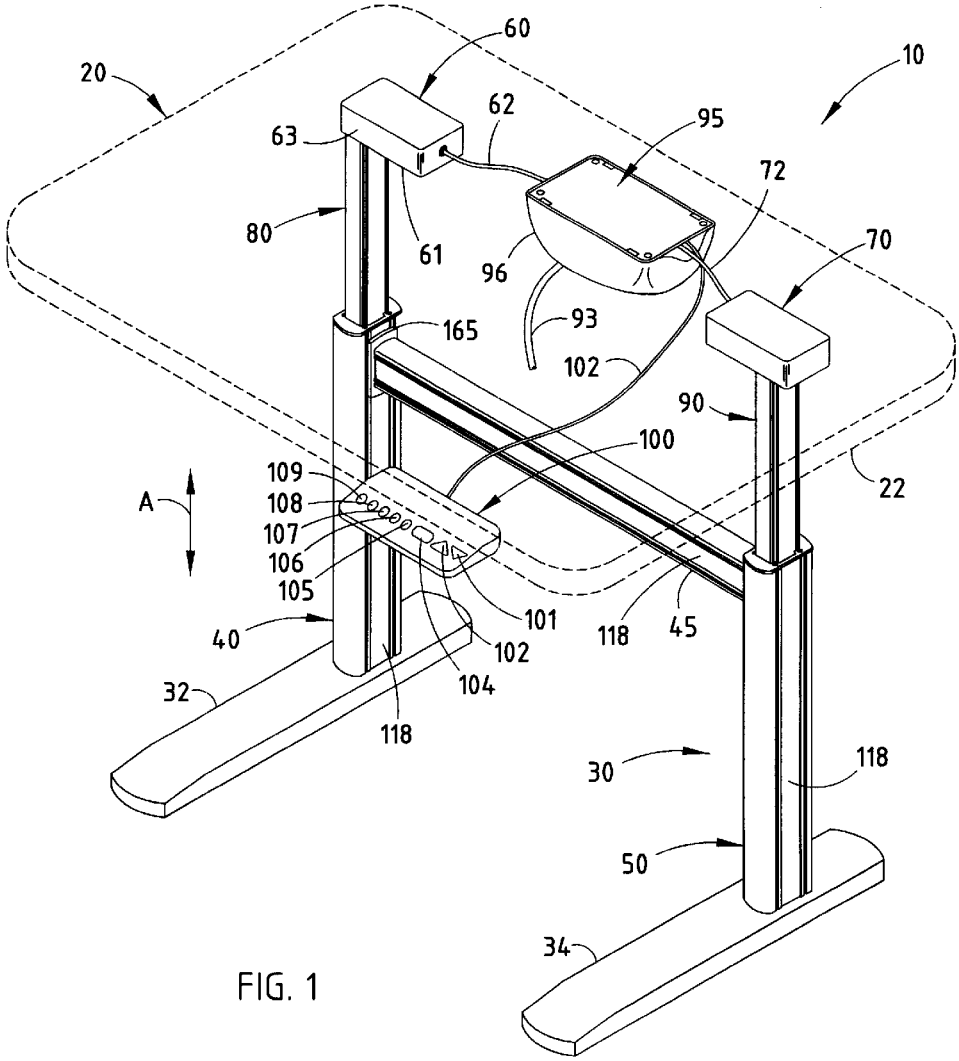
FIG. 1 is a perspective view of a table embodying the present invention, shown partly in phantom form.
Figure 2:
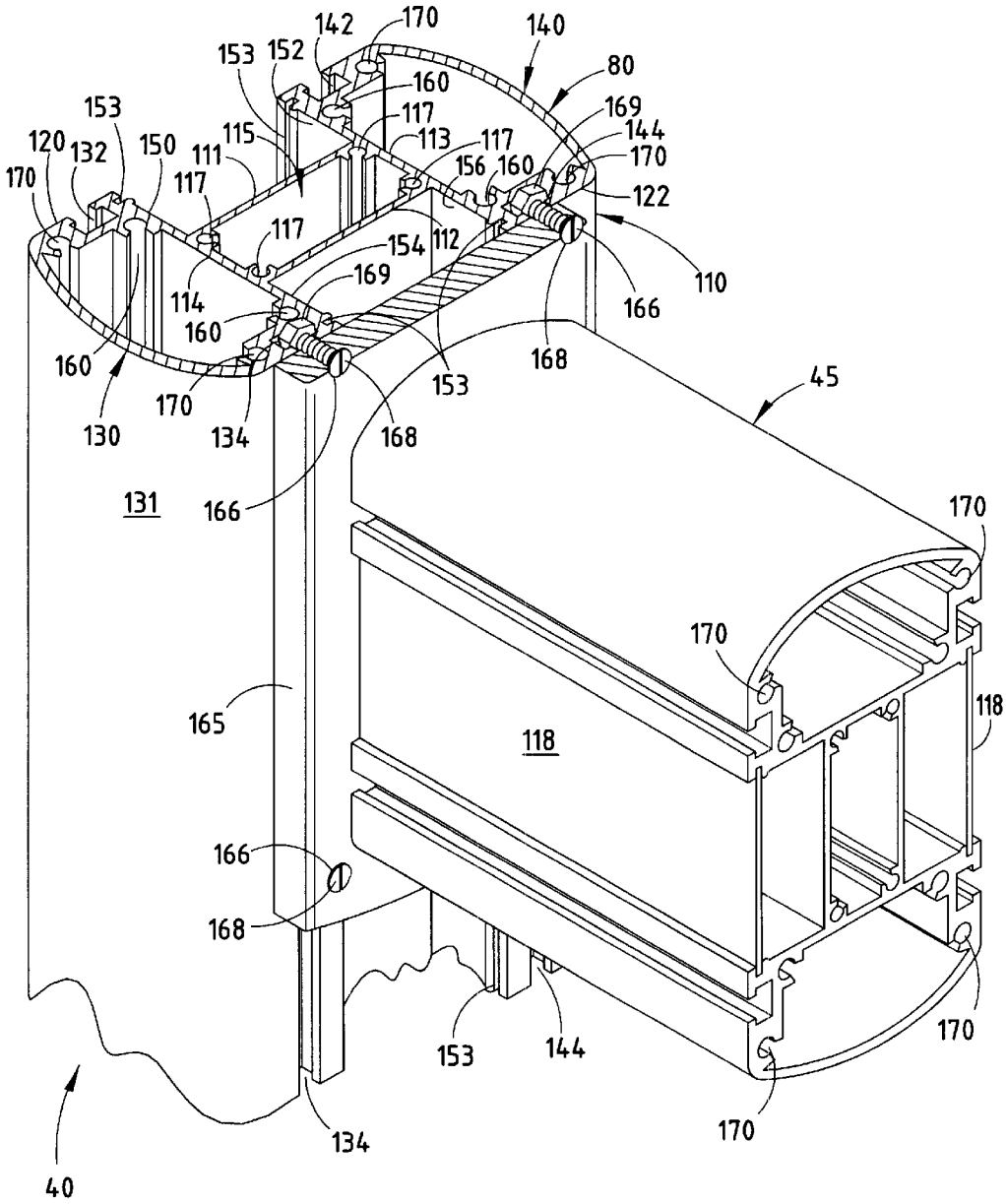
FIG. 2 is a greatly enlarged fragmentary, partly cross-sectional view of one of the table base legs and the cross member shown in FIG. 1.

Referring initially to FIG. 1, there is shown an adjustable table assembly 10 of the present invention, which includes a generally rectangular, horizontally extending work surface 20 coupled to a base 30 including a pair of horizontally extending feet 32 and 34 to which there is mounted vertically extending base legs 40 and 50 in spaced relationship to one another and coupled by a cross member 45. The work surface may be of any conventional material, such as a laminated composite board, solid wood, polymeric material, glass, or the like. Mounted to the underside 22 of work surface 20 are a pair of motor actuating assemblies 60 and 70, each of which are substantially identical. Assemblies 60 and 70 each include an electrical motor, a low profile housing enclosing an electrical drive motor and right angle drive which is coupled to a screw jack as described below and which, in turn, is coupled to a thrust nut mounted in each of the legs 40 and 50, respectively.

Telescopic leg assemblies 80 and 90 couple the motor actuating assemblies 60 and 70 to base legs 40 and 50, respectively, and extend within the base legs when retracted and out of the base legs when extended, as the work surface height is adjusted in a vertical direction as indicated by arrow A in FIG. 1. Each of the motor actuating assemblies 60 and 70 is coupled to a motor control 95 also mounted to the underside 22 of work surface 20 by means of a conductor or cord 62 for actuator 60 and 72 for actuator 70. Conductors 62 and 72 are signal and power control lines and are coupled within a unique housing 96 of motor control 95, which is described in greater detail in copending patent application entitled ADJUSTABLE TABLE CORD STORAGE ASSEMBLY, Ser. No. 09/573,144 filed on May 17, 2000, now U.S. Pat. No. 6,360,675, the disclosure of which is incorporated herein by reference.

The motor control 95 is coupled to an operator control 100 by means of a conductor or cord 102. Operator control 100 is mounted to the underside front edge of surface 22 such that the operator control switches are conveniently accessible. Operator control 100 includes a plurality of switches such as a down control touch switch 101, an up control touch switch 102, a digital display 104 displaying the numeric height level of work surface 20 and memory position switches 105 through 109. An AC power cord 93 having a conventional electrical plug (not shown) is coupled to a wall outlet for supplying operating power to the motor control 95 which, in turn, converts the input power to the desired operating voltages for motors contained within actuators 60 and 70 in response to commands from operator control 100 through motor control 95. Control 95 includes a microprocessor programmed to receive signals representing the position of the telescopic leg assemblies 80 and 90 such that certain frequently used or desired positions can be stored in memory and, by actuating one of the preset switches 105–109, the table surface can be moved to the desired position in response to an input command signal. Although the table shown in FIG. 1 is a two-pedestal table, it can be appreciated that the adjustable leg assembly of the present invention can be employed with single pedestal tables, tables having three or more legs or dual section tables with a front and rear work surfaces. Also, the adjustable leg assembly of the present invention can be employed in environments other than a vertical adjustable table.

In the preferred embodiment of the invention, the actuators 60 and 70 are electrically driven screw jacks driven by DC controlled, pulse-width modulated motors, although it should be appreciated that hydraulic or other actuators can be employed using the telescopic leg assemblies 80 and 90 of the present invention.

Having briefly described one table assembly embodying the present invention shown in FIG. 1, a detailed description of the adjustable leg assembly is now presented in conjunction with FIGS. 2 through 7. It is to be understood that each of the adjustable leg assemblies 80 and 90 mounted within base legs 40 and 50, respectively, are identical and, therefore, a description only of one of the leg assemblies 80 is present herein.

Table 10 shown in FIG. 1 is supported by the pair of base legs 40 and 50, which are coupled together near their upper end, as seen in FIG. 1, by cross member 45. Each of members 40, 50 and 45 comprise identical rectilinear extruded members, which are shown in detail in FIG. 2. A description, therefore, is provided only for base leg 40 which comprises an elongated, somewhat rectangular extrusion 110 having a central, generally rectangular, longitudinally extending channel 115 defined by elongated side walls 111, 112 and end walls 113, 114. Channel 115 houses and receives a screw jack 230 (FIG. 3), as described below. Walls 113 and 114 extend beyond channel 115 to the outer surface 120 of extrusion 110 and to the inner surface 122. Self-tapping screw-receiving cylindrical channels 117 are formed at the corners of channel 115 for receiving, as described in connection with FIGS. 3 and 4, a thrust nut at the top of each of the legs, including leg 40. The integral extrusion 110 further includes a forward section 130 and rear section 140 with each section including opposed, T-shaped slots 132, 134 on the front section and 142, 144 on the rear section, respectively, for receiving therein mounting nuts as described in greater detail below.

Figure 3:
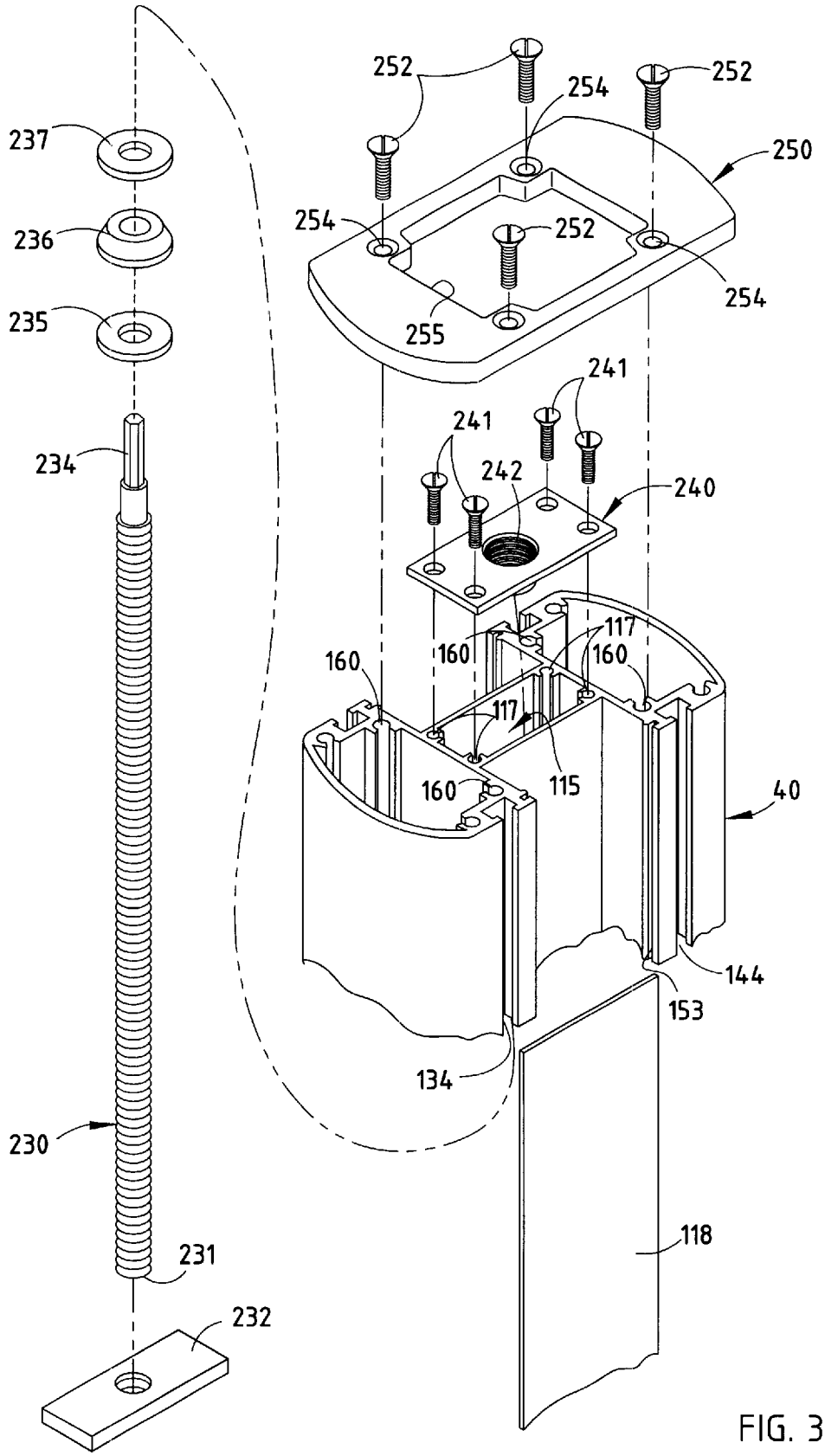
FIG. 3 is a fragmentary perspective exploded view of a part of the upper section of one of the base legs shown in FIG. 1 together with the drive mechanism which is enclosed therein upon assembly.
Figure 4:
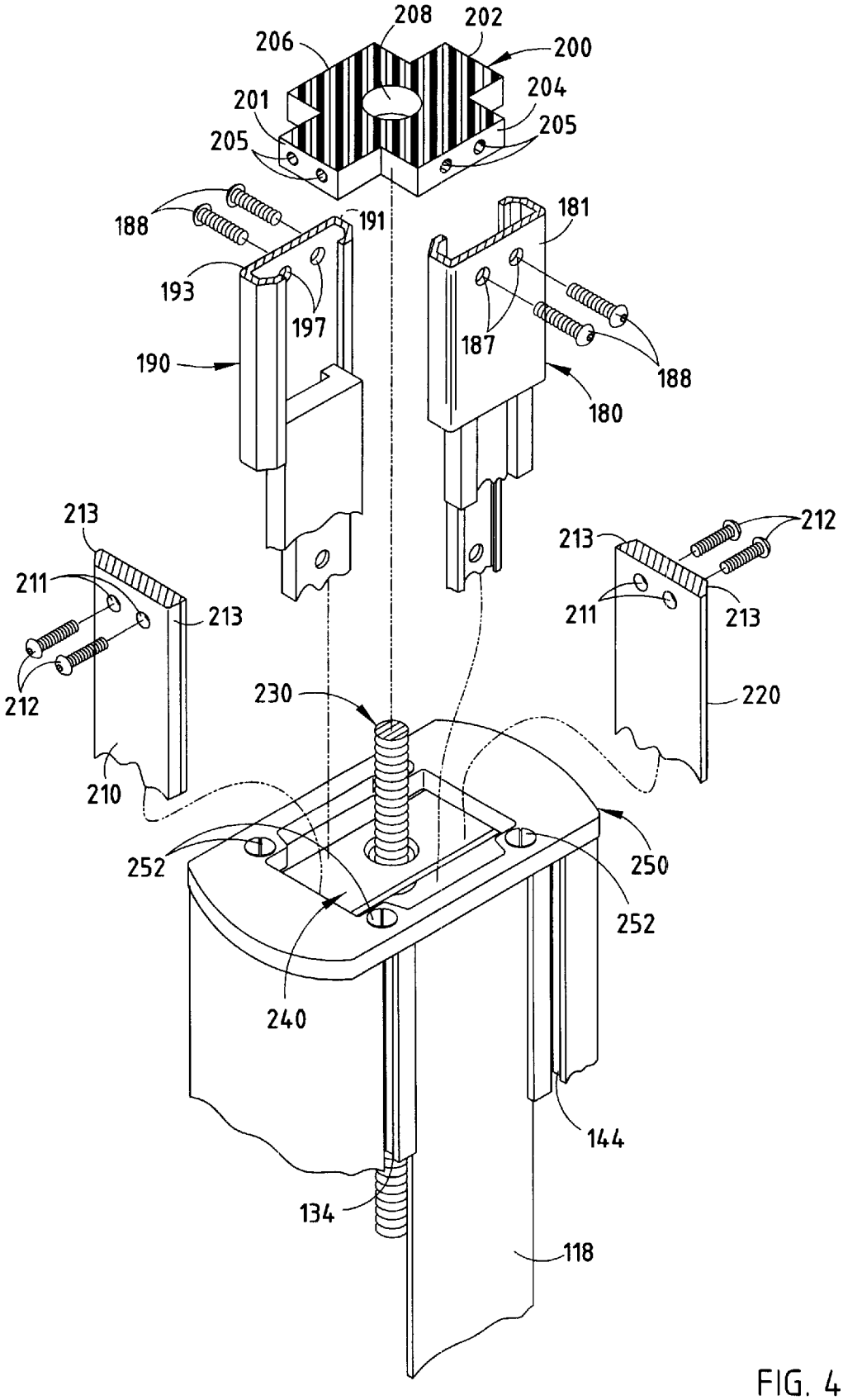
FIG. 4 is a fragmentary perspective exploded view, partly in cross section, of the assembly of the telescopic leg assembly shown in FIGS. 1 and 3.

In addition, inside facing walls 150, 152, 154 and 156 (defined by extended end walls 113, 114) on opposite sides of channel 115 include opposed facing slots 153 for receiving, as described below, trim panels which can be employed to provide a finished exterior to the leg defined by the extrusion. The outer sections 130 and 140 can be integrally formed, defining convex walls 131 and 141, respectively, in one embodiment, or, as described below in connection with FIG. 8, the outer sections can be modified to a variety of shapes and may also include opposed facing slots for receiving trim panels as desired. The extrusion 110 forming the legs further includes additional elongated cylindrical channels such as channels 160 at the outside corners of walls 113 and 114, which are employed for receiving fastening screws for the attachment of a mounting cap 250, as seen in FIGS. 3 and 4. Extrusion 110 is identical for both legs 40, 50 and cross member 45 and may be made of any suitable material, although preferably is an aluminum alloy, such as a 6005-T5, which is anodized to provide a finish suitable for universal application. The extrusions can likewise be powder coated or otherwise finished. Also, materials other than aluminum can be employed, although aluminum is the preferred metal. The outer ends 130, 140 of the extrusion 110 also include enclosed elongated cylindrical apertures 170, which are employed for providing attachment for mounting plate 165 (FIG. 2) which secures an identical extrusion 45 forming a cross piece to the legs 40 and 50 as now described.

Mounting plate 165 is a rectangular plate having four apertures (not shown) which align with mounting apertures 170 in cross member 45 and which are employed to first secure a mounting plate 165 to opposite ends of cross member 45. Subsequently, the mounting plates, which include four recessed mounting apertures 166 generally located at the corners thereof, are secured to the table legs 40 and 50 near the top, as seen in FIG. 1, by means of threaded fasteners 168, such as flat head screws, which extend through apertures 166 and into the T-shaped slots 134, 144, which receive generally rectangular fastening nuts 169 having a size which captively holds the nuts within the T-shaped slots 134, 144 and prevents rotation of the nuts while allowing the cross member to be vertically slid into position during assembly of the table. Once in position, the fasteners 168 are tightened to secure the interconnection of the cross member to the legs. The feet 32, 34 are secured to the bottom of the extruded legs 40, 50 utilizing the same apertures 170 on the outer corners of the extrusion 110. The feet 32, 34 may also be cast of aluminum and have a textured or otherwise treated surface which blends with or otherwise accentuates the appearance of legs 40, 50.

As seen in FIGS. 1, 3, 6, and 7, the facing slots 153 in extrusion 110 receives slide-in decorative trim panels 118 comprising elongated flexible rectangular strips which enclose the inner and outer sides of legs 40 and 50 as well as the front and back of cross member 45, as also seen in FIG. 1. Strips 118 are made of a suitable polymeric material which can have a color and texture to blend or contrast with the legs as desired to provide an appearance to the base for the work surface 20 which is appropriate for the environment in which the adjustable table is employed. The trim members are placed in the facing opposed slots 153 after the assembly of the telescopic leg sections 80 and 90 on the respective legs. The structure of the telescopic leg sections is now described in connection with FIGS. 3–7.

Figure 5:
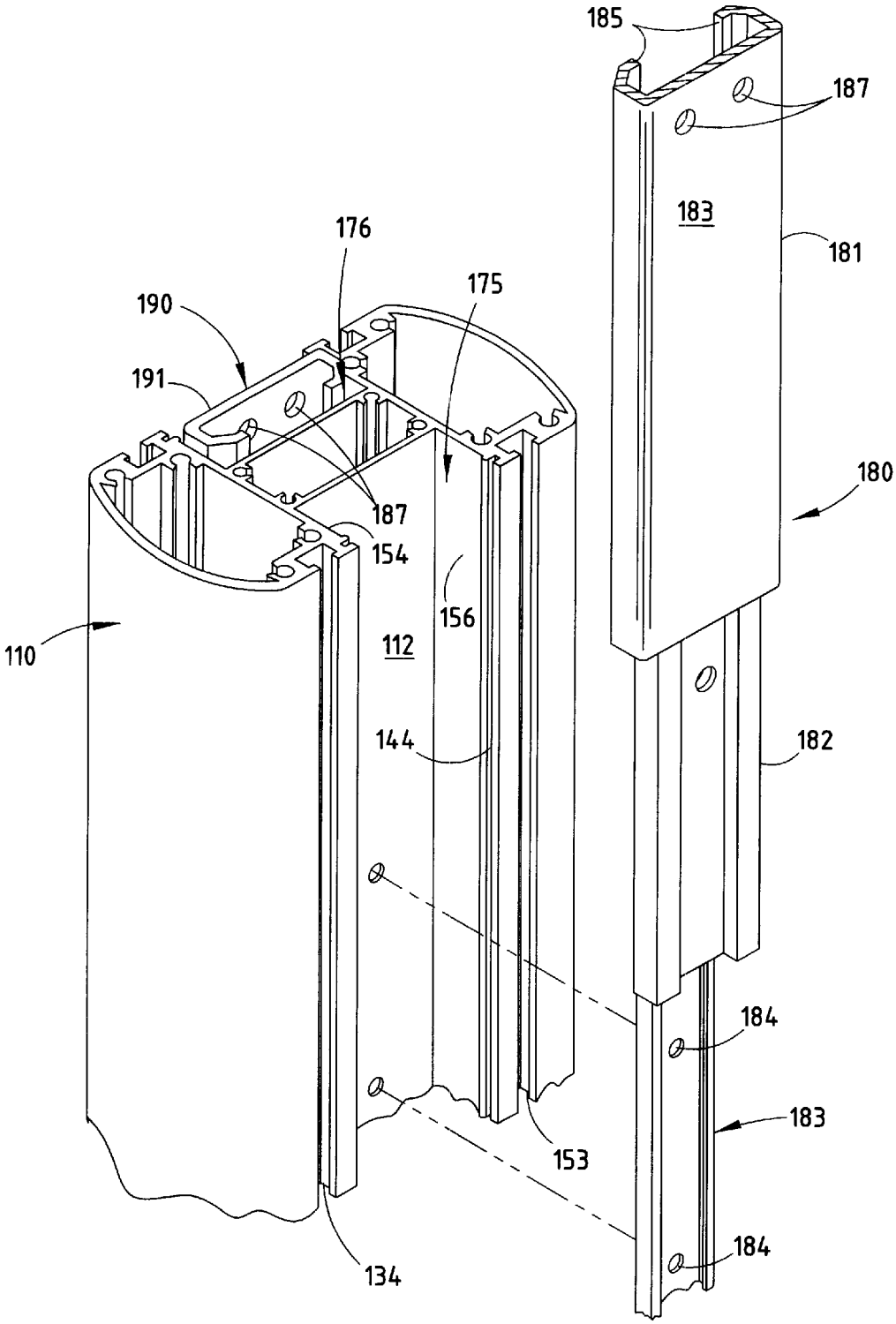
FIG. 5 is a fragmentary perspective exploded view of the mounting of one of the slides to the base leg.
Figure 6:
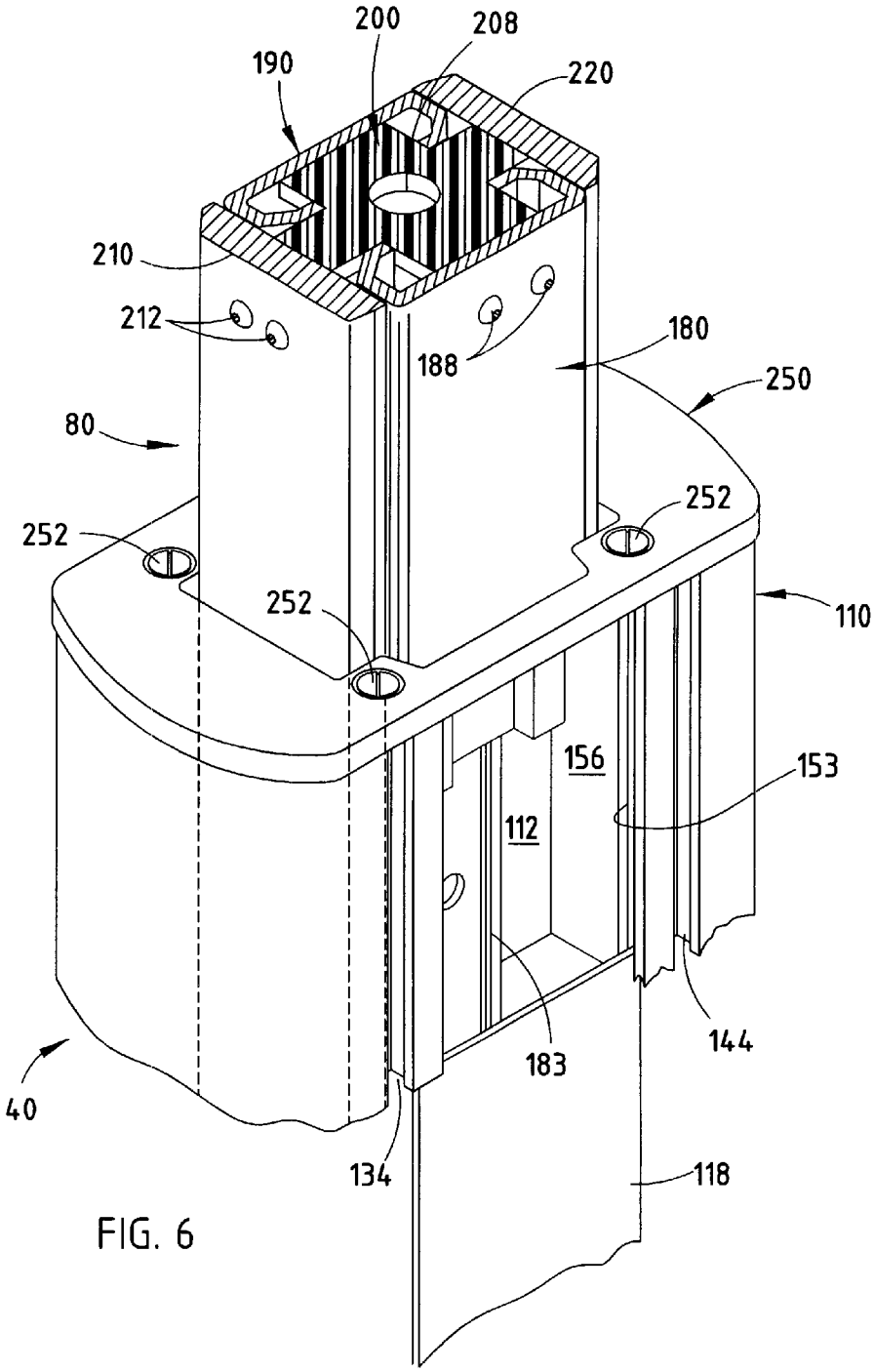
FIG. 6 is a fragmentary perspective view, partly in cross section, of the structure shown in FIGS. 3–5 shown assembled.

The telescopic leg sections 80 and 90 are identical and only section 80 is described in detail herein. Referring initially to FIG. 5, part of the telescopic leg assembly comprises a pair of multi-section slides, such as drawer slides, and, in the preferred embodiment of the invention as seen in FIG. 5, a first drawer slide 180 and a second drawer slide 190 are mounted within the rectangular channels 175 and 185 in extrusion 110. Each slide includes, in the preferred embodiment, three sections including an upper end 181, an intermediate section 182, and a lower end 183. End 183 has spaced-apart mounting apertures 184 therein for receiving fastening screws (not shown) which secure the end member 183 to the wall 112 of extrusion 110, as seen in FIGS. 5 and 6. The top sections 181, 191 of slides 180, 190, respectively, have a finished external surface 183, 193, respectively, and inwardly curved edges 185 to surround and conceal the space between the spaced-apart drawer slides for partially concealing the mechanism used for raising and lowering the table surface as described below.

The slides 180 in the preferred embodiment were conventional three-section drawer slides having an adjustable length of approximately 516 mm to allow vertical adjustment of the table height. Other slides having multiple sections providing shorter or longer adjustments may be employed. Surfaces 183 and 193 can be powder coated to match the legs, to contrast with the legs, or covered to provide whatever decorative appearance is desired. Sections 181 and 191 of each of the slides 180, 190 are substantially the only section which is exposed when the table is raised so the remaining sections need not have a decorative appearance. The sides 180, 190 provide lateral strength and support for the telescopic leg assemblies 80, 90 and include at their upper ends apertures 187 and 197 for attachment of the slide members to a generally +-shaped mounting block 200 (FIGS. 4 and 6) which can be integrally molded on the lower side 61 of the housing for control motor actuating unit 60 which, in turn, is mounted to the underside of work surface 20 utilizing conventional mounting screws. Thus, the lower end of slides 180, 190 are mounted within the channels of fixed legs 40 and 50, while the upper section is mounted to the movable table through mounting block 200 and the actuator control housing 63. Once installed, the lower and intermediate sections of the slides are concealed by trim panels 118.

Figure 7:
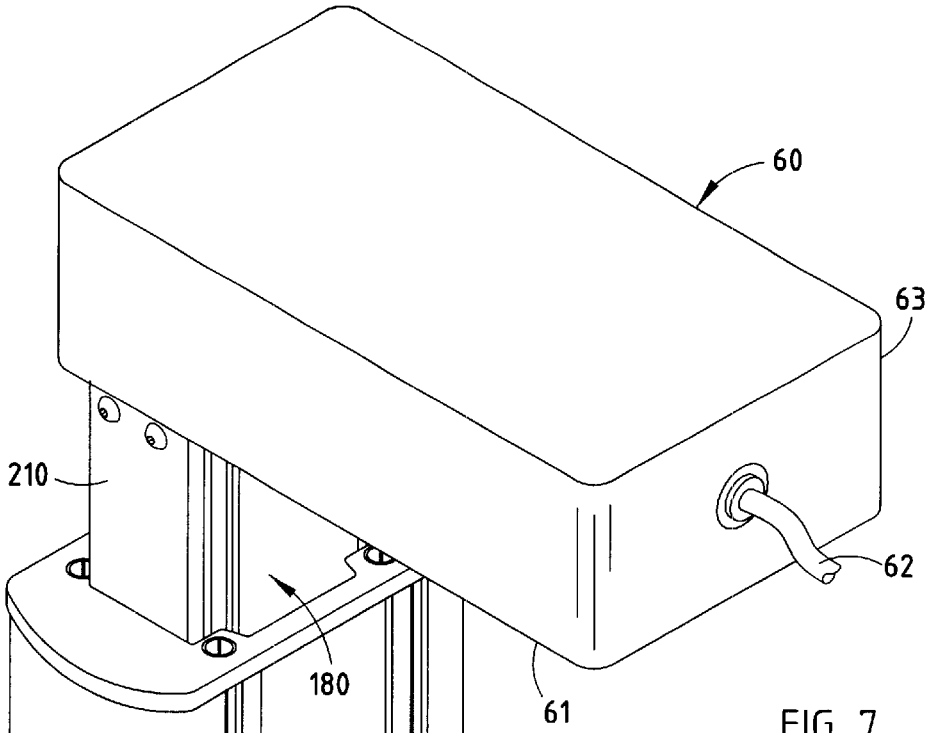
FIG. 7 is a fragmentary perspective view of one of the motor actuating units and its associated adjustable legs.

The opposed facing generally rectangular slides 180, 190 conceals the drive mechanism from opposite sides, while the remaining intermediate exposed sides are concealed by a pair of generally rectangular trim strips 210 and 220 (FIGS. 4, 6 and 7). For such purpose, each of the trim strips 210, 220 include mounting apertures 211 near the top such that fastening screws, such as self-threading screws 212 can be extended therethrough and mount the upper end of trim strips 210, 220 to the surfaces 201, 202 of block 200 in opposition to the mounting surfaces 204, 206 to which drawer slides 180 and 190 are secured by means of fastening screws 188, as seen in FIG. 4. For such purpose, block 200 may include suitable threaded apertures 205 to accommodate the fastening screws attaching the upper ends of slides 180, 190 thereto as well as trim strips 210, 220. Block 200 includes an aperture 208 to allow the upper end 234 of screw jack 230 to extend into the motor actuator 60, as seen in FIGS. 4 and 7.

The trim strips 210, 220 extend downwardly, generally in parallel spaced relationship to one another and serve to enclose the remaining two sides of the drive mechanism when the table is in a raised position. The trim strips 210, 220 may have a trapezoidal cross section with tapered edges 213 to provide a clean appearance to the trim members 210, 220 once the unit is assembled, as seen in FIGS. 6 and 7. The actuator mechanism of the preferred embodiment comprises a motor-driven screw-jack actuator which intercouples between the motor-actuator units 60 and 70 and the base legs 40, 50 as now described in conjunction with FIGS. 3 and 4.

The screw jack actuator comprises an elongated, threaded screw 230 which extends downwardly within the channel 115 of leg 40 and is seated on a generally rectangular guide block 232 which stabilizes the lower end 231 of screw 230 within channel 115. Block 232 is dimensioned to slide up and down within channel 115 as the assembly is raised and lowered. A thrust nut 240 receives the threaded screw 230 and includes a threaded aperture 242 for such purpose. Thrust nut 240 is secured to the upper end of leg 40 by means of four threaded fasteners 241 which mount the rectangular plate integrally including thrust nut 242 to cap the channel 115 by extending through the screw-receiving channels 117. The upper end of screw jack 230 includes a keyed end 234 which extends through washer 235, thrust bearing 236 and washer 237 and is conventionally coupled to the motor actuator unit 60 utilizing a right angle coupling having a collar with set screws or the like for securing end 234 to the actuator.

Once the slide members 180, 190 and trim members 210, 220 and the actuator 230 have been installed, a cover cap 250 is mounted over the end, as seen in FIG. 4, utilizing four self-threading screws 252 extending through apertures 254 in cap 250 to thread into channels 160 in extrusion 110. Cap 250 includes a generally rectangular-shaped aperture 255 providing sufficient clearance for the outer surfaces 183, 193 of the upper sections of slides 180, 190 to extend therethrough without contact and allowing the trim strips 210, 220 to move downwardly therethrough, as illustrated in FIG. 6, to provide a compact appearance to the unit, as best seen in FIG. 6, once assembled. Block 200 is an integrally formed part of the lower side 61 of the motor actuator housing 63 or can be separately attached to the lower side 61 of the motor actuator housing utilizing conventional fasteners. Block 200 provides the mechanical attachment to the motor actuator which, in turn, is conventionally attached to the underside of the work surface 20 utilizing fasteners extending through housing 63.

Upon actuation of the motor actuators by the operator intervention utilizing control 100, signals are sent from the motor controller 95 to each of the motor actuators 60 and 70, causing screw jacks 230 in each of the legs to rotate, raising and lowering the screw jack with respect to the fixed thrust nut 240 mounted to the lower legs 40, 50 of the table causing the table to either raise or lower in a direction indicated by arrow A. The drawer slides 180, 190 are made of steel and provide strength and rigidity to the telescopic interconnection between the underside 22 of work surface 20 and the fixed legs 40, 50 while, together with strips 210, 220, concealing the screw jack assembly 230. In other embodiments, hydraulic cylinders may be employed and, when extended above legs 40 and 50, are similarly concealed with trim strips and slides. In some heavy duty applications, it may be desirable to provide four drawer slides instead of two drawer slides and two trim strips, in which case the extrusion 110 would be modified by removing the integral crowned outer surfaces 131, 141 and providing a channel similar to channels 175, 176 on the sides of the legs, which then would be covered by trim panels 118 as in the alternative embodiments shown in FIG. 8 below.

In the preferred embodiment of the invention, the screw jack actuators 60, 70 were low profile motor-driven assemblies available from Suspa Incorporated, and each provides a lifting force of 165 pounds such that work surface 20 can safely support 330 pounds of weight and be controlled for raising and lowering the table through a distance of 516 mm.

Figure 8:
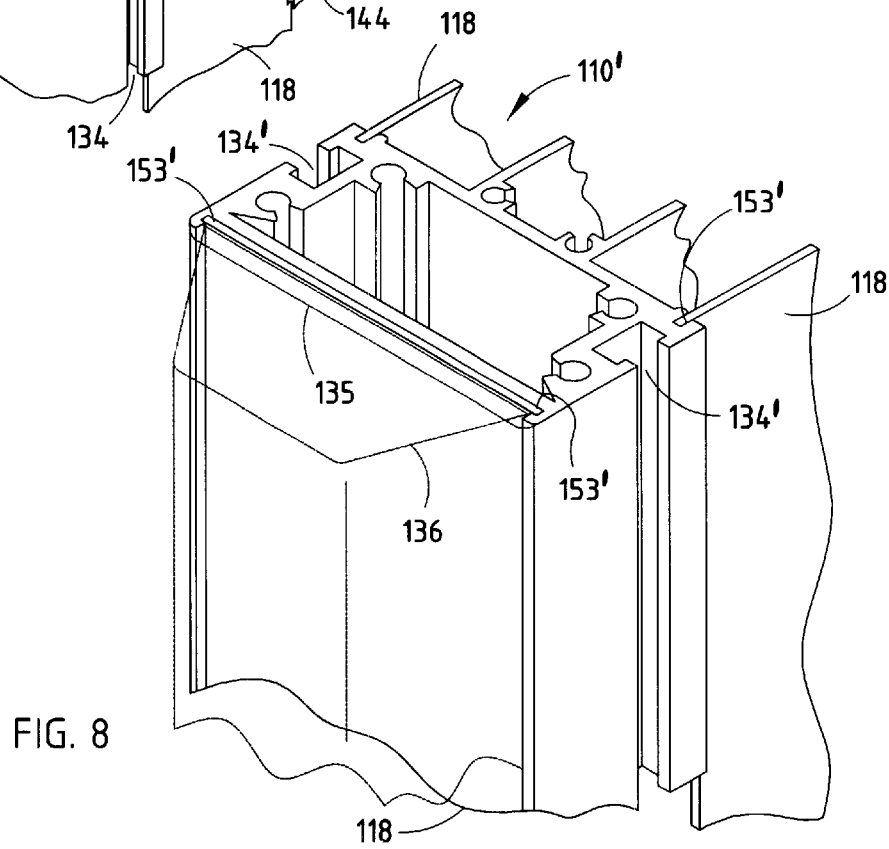
FIG. 8 is a fragmentary perspective view, partly in phantom form, illustrating alternative embodiments of an extrusion which can be employed for the base leg and cross members of the invention.

Referring now to FIG. 8, there is shown an alternative embodiment of the extrusion 110 identified as extrusion 110 with substantially identical elements being identified with the same reference numeral followed by a prime (') symbol. In place of ends 131, 141, extrusion 110' may include in one embodiment facing slots, such as slots 153' in the ends as well as the sides for receiving trim panels such as panels 118 for all sides of the fixed legs. Additionally, instead of the convexly curved outer surfaces 131, 141 and in place of the trim slots 153' and trim panels 118, extrusion 110' may include a relatively flat outer surface identified in phantom lines in FIG. 8 as surface 135 or a trapezoidal surface identified as 136 in FIG. 8, or any other desired configuration which can be accomplished through formation of the extrusion mold. The cross member 45 would be similarly formed to conform the legs and cross member for a given table design. If desired, the T-shaped slots 132, 134, 142, and 144, which themselves provide an accent to the legs, can be capped with a trim bead.

Although the extendable leg assembly of the present invention is particularly suited for use in connection with a work surface to be raised and lowered, it can be used in any environment in which a first member is desired to be moved with relation to a second member and where desired stability and esthetics is required. When used in combination with the unique extrusion and trim panels of the leg assemblies of the present invention, the telescopic section and the base legs provide a unique adjustable table mounting assembly which is very flexible in its design, accommodates different trim accents, and provides a reliable, attractive table assembly.

It will become apparent to those skilled in the art that various modifications to the preferred embodiments of the invention as described herein can be made without departing from the spirit or scope of the invention as defined by the appended claims.

The invention claimed is:

1. An adjustable leg assembly comprising:

an actuator having a screw jack;

a base member having a central elongated channel defined in part by a pair of opposed mounting surfaces, said channel receiving said screw jack therein; and a telescopic leg extendable within said channel, said leg defined in part by at least a first multiple section slide having end members slidably movable with respect to one another wherein one end member is fixedly mounted to one of said mounting surfaces of said base member on a side of said mounting surface opposite said channel and the other end member has an end which is coupled to said actuator to be movable with respect to said base member such that said other end member extends over and covers said screw jack when said actuator extends said telescopic leg from said channel.

2. The assembly as defined in claim 1 wherein said base member includes a thrust nut for coupling said screw jack of said actuator to said base member.

3. The assembly as defined in claim 2 and further including a second multiple section slide having end members slidably movable with respect to one another wherein one end member is coupled to said base member on a mounting surface opposite said first slide and the other end member has an end which is coupled to said actuator.

4. The assembly as defined in claim 3 and further including a work surface and wherein said actuator includes a housing coupled to one side of said work surface.

5. An adjustable table comprising:

a work surface;

at least one adjustable leg coupled to said work surface, said adjustable leg defined by an actuator having a housing coupled to said work surface and a movable element;

a base leg having a central elongated channel defined in part by a pair of opposed mounting surfaces for receiving said movable element therein; and a pair of slides having end members slidably movable with respect to one another wherein one end member has an end which is fixedly coupled to said actuator and the other end member is coupled to one of said mounting surfaces of said base leg such that said one end member partially extends over said movable element when said movable element extends from said channel when said actuator raises the height of said work surface, and further including a mounting block coupled to said actuator housing for receiving said end of said one end member of said slides, wherein said slides are mounted between said mounting block and said opposed mounting surfaces of said base leg and wherein said mounting block is integral with said housing of said actuator, and wherein said slides are mounted in opposed relationship to said mounting block and said base leg and wherein said assembly further includes a pair of trim strips extending from said block to said base leg in alternate spaced relationship to said slides.

6. The adjustable table as defined in claim 5 wherein said base leg includes recesses for receiving said opposite ends of said slides.

7. The adjustable table as defined in claim 6 wherein said recesses of said base leg are defined by opposed facing walls having opposed facing slots for receiving a trim panel.

8. The adjustable table as defined in claim 7 and further including a trim panel insertable within said opposed facing slots of said base leg for covering said opposite end of a slide.

9. An adjustable leg assembly comprising:

an actuator having a housing and a movable element;

a mounting block coupled to said housing;

a base leg coupled to said movable element; and a pair of multiple section telescopic slides, each having one end secured to said mounting block and an opposite end secured to said base leg such that as said movable element of said actuator moves in first and second directions, said mounting block moves with respect to said base leg and extends and retracts said telescopic slide, wherein said telescopic slides are mounted in opposed relationship to said mounting block and said base leg and wherein said assembly further includes a pair of trim strips extending from said block to said base leg in alternate spaced relationship to said slides.

10. The assembly as defined in claim 9 wherein said base leg includes recesses for receiving said opposite ends of said slides.

11. The assembly as defined in claim 10 wherein said recesses of said base leg are defined by opposed facing walls having opposed facing slots for receiving a trim panel.

12. The assembly as defined in claim 11 and further including a trim panel insertable within said opposed facing slots of said base leg for covering said opposite end of a slide.

13. The assembly as defined in claim 10 wherein said base leg is an extrusion having a central channel for receiving said movable element of said actuator.

14. The assembly as defined in claim 13 wherein said mounting block is integral with said housing of said actuator.

15. The assembly as defined in claim 14 wherein said actuator includes an electrical motor and said movable element comprises a screw jack.

16. The assembly as defined in claim 15 and further including a thrust nut coupled to said base leg for receiving said screw jack.

17. An adjustable table comprising:

a work surface;

at least one adjustable leg coupled to said work surface, said adjustable leg defined by an actuator having a housing coupled to said work surface and a screw jack;

a base leg having a central elongated channel defined in part by a pair of opposed mounting surfaces for receiving said adjustable leg therein;

a pair of multiple section telescopic slides mounted in opposed relationship to said base leg and actuator, wherein each has end members movable with respect to one another wherein one end member of each slide is fixedly mounted to said actuator and the other end member of each slide is coupled to one of said mounting surfaces of said base leg such that said one end member of each slide partially extends over said screw jack when said screw jack extends from said channel when said actuator raises the height of said work surface; and a pair of trim strips extending from said block to said base leg in alternate spaced relationship to said slides.

18. An adjustable table comprising:

a work surface;

at least one adjustable leg coupled to said work surface, said adjustable leg defined in part by an actuator mounting block and an actuator having a housing coupled to said work surface and a screw jack;

a base leg having a central elongated channel defined in part by a pair of opposed mounting surfaces for receiving said adjustable leg therein, wherein said adjustable leg is further defined by a pair of multiple section telescopic slides having end members slidably movable with respect to one another wherein an end of one end member of each slide is fixedly mounted to said actuator mounting block at opposed sides and an end of the other end member of each slide is coupled to one of said mounting surfaces of said base leg such that said one end member extends over and covers said screw jack when said screw jack extends from said channel as said actuator raises the height of said work surface.

19. The adjustable table as defined in claim 18 wherein said mounting block is integral with said housing of said actuator.

20. The adjustable table as defined in claim 19 wherein said actuator includes an electrical motor and said movable element comprises a screw jack.

21. The adjustable table as defined in claim 20 and further including a thrust nut coupled to said base leg for receiving said screw jack.

* * * * *